US006538384B2

(12) United States Patent
Gielen et al.

(10) Patent No.: US 6,538,384 B2
(45) Date of Patent: Mar. 25, 2003

(54) DISCHARGE LAMP HAVING DISCHARGE SPACE WITH SPECIFIC FILL CONCENTRATION

(75) Inventors: Herman Johannus Gertruda Gielen, Roosendaal (NL); Koen Leo Costantia Lenaerts, Turnhout (BE); Bart Dilissen, Turnhout (BE)

(73) Assignee: Koninklijke Philips Electronics N.V., Eindhoven (NL)

( * ) Notice: Subject to any disclaimer, the term of this patent is extended or adjusted under 35 U.S.C. 154(b) by 177 days.

(21) Appl. No.: 09/817,106

(22) Filed: Mar. 26, 2001

(65) Prior Publication Data

US 2002/0033673 A1 Mar. 21, 2002

(30) Foreign Application Priority Data

Mar. 31, 2000 (EP) ..... 00201184

(51) Int. Cl.[7] ..... M01J 17/20

(52) U.S. Cl. ..... 313/639; 313/490; 313/571; 313/637; 313/573

(58) Field of Search ..... 313/490, 571, 313/573, 637, 639, 634

(56) References Cited

U.S. PATENT DOCUMENTS

| | | | | |
|---|---|---|---|---|
| 4,481,442 A | 11/1984 | Albrecht et al. | ..... | 313/498 |
| 5,570,372 A | 10/1996 | Shafer | ..... | 370/108 |
| 5,953,049 A | 9/1999 | Horn et al. | ..... | 348/15 |

FOREIGN PATENT DOCUMENTS

| | | | | |
|---|---|---|---|---|
| EP | 0418396 A1 | 3/1991 | ..... | H04N/7/15 |
| EP | 058135921 | 7/1993 | | |

OTHER PUBLICATIONS

Philps Compact Lighting Catalog 1995/96 pp. 98–99.

*Primary Examiner*—Vip Patel
(74) *Attorney, Agent, or Firm*—Dicran Halajian

(57) ABSTRACT

The invention relates to a tubular discharge lamp (1) with a wall (4) which is transparent to UV-radiation. The tube (2) encloses a discharge space (5) having an internal diameter D. The discharge space (5) comprises a filling of mercury metal vapor in a concentration range of 0.4–2.5 mg/cm$^3$. A reduction of both the diameter D from about 22 mm down to about 13.5 mm and the average mercury concentration from about 1.7 mg/cm$^3$ down to about 0.8 mg/cm$^3$ leads to an increase in the effective germicidal UV-output of the lamp (1) of about 35%.

4 Claims, 1 Drawing Sheet

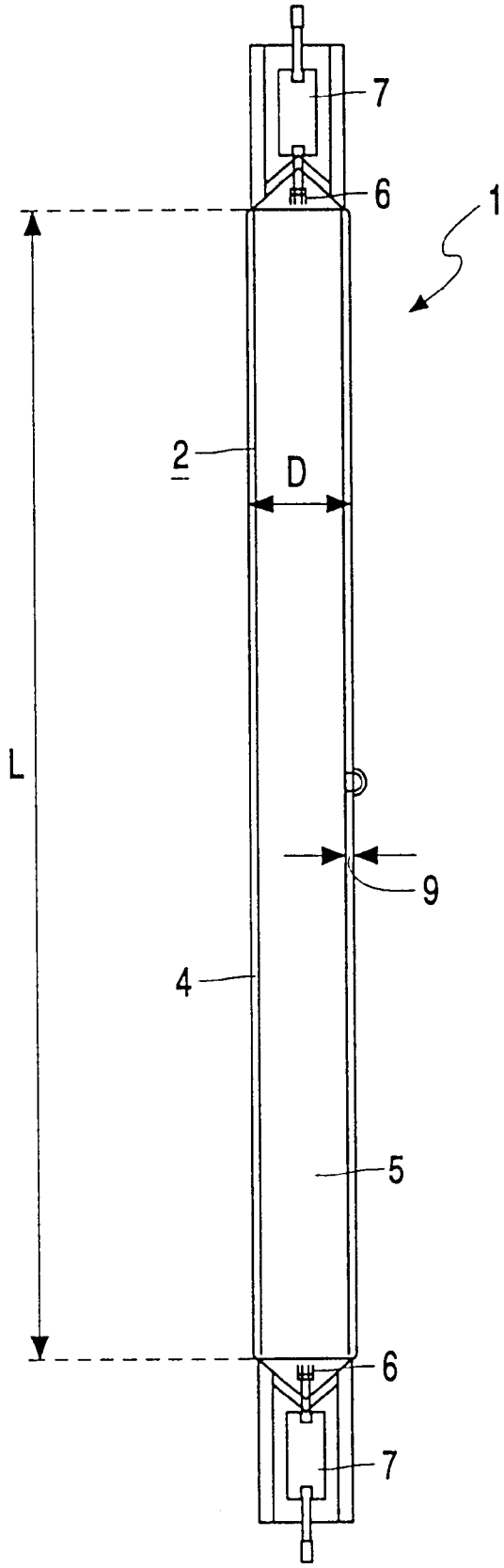
7
6
1
2
D
L
9
4
5
6
7

DISCHARGE LAMP HAVING DISCHARGE SPACE WITH SPECIFIC FILL CONCENTRATION

The invention relates to a mercury vapor discharge lamp comprising:

- a tubular lamp vessel with a wall which is permeable to UV radiation and which surrounds a discharge space with a diameter D in a gastight manner;
- a filling provided in the discharge space and comprising mercury with an average concentration of at least 0.4 $mg/cm^3$ and of at most 2.5 $mg/cm^3$; and
- a pair of electrodes with an electrode spacing L arranged in the discharge space.

Such a lamp is known from general use and is described inter alia in the Philips Compact Lighting Catalogue 1995/96, pp. 1–98:1–99, for example a lamp with type designation HOK 20/100. The known lamp is a UV lamp and is suitable for use in various chemical processes, for example paint curing processes, but it may alternatively be used for other processes in which UV radiation is required, such as the disinfection of water in water purification installations or for sterilization, for example of operating theatres in hospitals. The known UV lamp has an effective UV output in the UV-C/B region mainly at 254 nm, i.e. close to the wavelength of 265 nm where disinfection takes place most effectively. The effective UV output of the lamp is the UV radiation emitted by the lamp during operation in a wavelength range of 220–320 nm, which UV radiation is utilized for, for example, disinfection and sterilization. In the known lamp, the wall is made of quartz glass, i.e. glass having a $SiO_2$ content of at least 95% by weight. The wall of the lamp reaches a temperature of between 600 and 900° C. during operation, and the mercury of the filling is fully evaporated. Embodiments of the known lamp are available in a power range of, for example, 400 to 17,000 W. A lamp with a power of approximately 2100 W has an internal diameter of approximately 22 mm, an average mercury concentration of approximately 1.7 $mg/cm^3$, an electrode spacing of approximately 200 mm, and a total length of approximately 250 mm, which length is determined substantially by the electrode spacing. The known lamp is denoted a medium-pressure discharge lamp by those skilled in the art of lamp technology. Present systems in water purification installations are geared to lamps having a length of between 200 and 300 mm. A disadvantage of the known lamp is that the effective UV output of the lamp is obtained with a comparatively low efficacy. To achieve the desired disinfection of the water, accordingly, a comparatively large number of lamps is required and comparatively much energy is consumed. In addition, comparatively much energy is dissipated in the form of heat and light, which promotes a disadvantageous growth of algae on material of the water purification installations.

The invention has for its object to provide a discharge lamp of the kind described in the opening paragraph whose effective UV output is increased while its power rating remains the same. The discharge lamp of the kind described in the opening paragraph is for this purpose characterized in that the diameter D of the discharge space is chosen so as to lie in a range from 10 to 15 mm. Table 1 lists a number of characteristics of lamps according to the invention and of the known lamp of equal length and equal power. Table 2 shows characteristics of lamps according to the invention of the same length and a power of 1200 W. In Table 1, R1 is the known lamp, which is included here as a reference, and the effective UV output of R1 was set for 100%. As the internal diameter of the lamp decreased by approximately 30%, from 21.6 mm to 15 mm, a comparatively small, gradual overall increase of approximately 4% was found to be achieved in the effective UV output, see lamps L6, L7, and L8 in Table 1 and lamps L12, L13, and L14 in Table 2. It was surprisingly found, however, that a further decrease in the internal diameter led to a considerably changed effect of the diameter on the effective UV output. A strong increase in the effective UV output of no less than approximately 17% was found to accompany a diameter decrease of no more than 10%, from 15 mm down to 13.5 mm, see lamps L4 and L6 in Table 1 and lamps L11 and L12 in Table 2. A still further decrease in the internal diameter from 13.5 mm to, for example, 10.75 mm in experiments was found to cause a decrease in the effective UV output of the lamp. The effective UV output of these lamps, however, is still higher than that of the known lamp.

The walls of lamps whose diameters were chosen to be smaller than 10 mm reach such a high temperature during operation that there is a considerable risk of deformation or explosion of the lamp.

A comparison of lamps having at least substantially the same mercury concentration and the same electrode spacing, but with varying lamp diameters, for example the lamps L8, L5, and L2 of Table 1, clearly shows the effect of the diameter on the effective UV output of the lamp as described above. It is apparent from the data of Table 1 that the effective UV output is a maximum for a lamp according to the invention having an internal diameter of 13.5 mm, which lamp has an approximately 21% higher effective UV output than the lamp of the same power rating, the same mercury concentration, and the same electrode spacing, but with an internal diameter of 21.6 mm, cf. lamps L5 and L8 of Table 1.

TABLE 1

| Lamp no. | Internal diameter (mm) | Power (Watt) | Electrode spacing (mm) | Hg conc. ($mg/cm^3$) | Relative effective UV output (%) |
|---|---|---|---|---|---|
| L1 | 10.75 | 2500 | 240 | 0.8 | 117 |
| L2 | 10.75 | 2500 | 240 | 0.9 | 121 |
| L3 | 13.5 | 2317 | 240 | 0.6 | 135 |
| L4 | 13.5 | 2500 | 240 | 0.7 | 135 |
| L5 | 13.5 | 2500 | 240 | 1.0 | 128 |
| L6 | 15 | 2500 | 240 | 1.4 | 111 |
| L7 | 18 | 2500 | 240 | 1.2 | 105 |
| L8 | 21.6 | 2500 | 240 | 1.0 | 107 |
| R1 | 21.6 | 2500 | 240 | 1.7 | 100 |
| L9 | 21.6 | 2500 | 240 | 2.2 | 94 |

Preferably, the internal diameter of the lamp according to the invention is chosen to lie within a region of 12 to 14 mm. It was found that the effective UV output is comparatively high in this region and is at least substantially independent of the lamp diameter. This renders it possible to use a constant time period for the application of a comparatively accurate dose of UV radiation, whereby the risk of an underdose or overdose of UV radiation is considerably reduced.

In an embodiment of the lamp, the electrode spacing L is chosen to lie in the range from 200 to 300 mm. Dimensions of present systems are geared to the use of the known lamp whose electrode spacing is approximately 240 mm. If the electrode spacing in the lamp according to the invention is the same as that in the known lamp used, the lamp may have the same dimensions as the known lamp. The lamp according to the invention is thus suitable for use in the retrofit market because the known lamp can be simply replaced with the lamp according to the invention without changes in dimensions of existing systems being required.

In a favorable embodiment of the lamp according to the invention, the latter has an average mercury concentration of 0.5 to 1.1 mg/cm$^3$ in the discharge space. The average mercury concentration is approximately 1.7 mg/cm$^3$ in the known lamp R1. It was found that an increase of up to approximately 7% in the effective UV output of the lamp as compared with the UV output of the known lamp is achieved with lamps according to the invention having an average mercury concentration of 0.5–1.1 mg/cm$^3$. This is demonstrated by lamps L8 and R1 of Table 1. The lamps L3, L4, and L5 with an internal diameter of 13.5 mm also show a positive effect of a decrease in the mercury concentration on the effective UV output; an increase in the effective UV output of approximately 7% is observed here as well. A decrease in the internal diameter from 21.6 mm to 13.5 mm in combination with a decrease in the mercury concentration from 1.7 mg/cm$^3$ to 0.7 mg/cm$^3$ causes an increase in the effective UV output of approximately 35%, cf. lamps R1 and L4 of Table 1. It was further found from experiments that the effect of the internal diameter and the mercury concentration on the effective UV output of the lamp also occurs in lamps having different powers, for example lamps having a power of 1200 W, cf. lamps L10 to L14 in Table 2. An increase in the mercury concentration, for example up to 2.2 mg/cm$^3$, leads to a decrease in the effective UV output in the case of lamps having an internal diameter of 21.6 mm, as compared with the known lamp, cf. The lamps R1 and L9 of Table 1.

TABLE 2

| Lamp no. | Internal diameter (mm) | Power (Watt) | Electrode spacing (mm) | Hg conc. (mg/cm$^3$) | Relative effective UV output (%) |
|---|---|---|---|---|---|
| L10 | 10.75 | 1200 | 240 | 0.9 | 110 |
| L11 | 13.5 | 1200 | 240 | 1.0 | 115 |
| L12 | 15 | 1200 | 240 | 1.4 | 102 |
| L13 | 18 | 1200 | 240 | 1.2 | 95 |
| L14 | 21.6 | 1200 | 240 | 1.7 | 95 |

It is further noted that a UV low-pressure mercury vapor discharge lamp is generally known. Low-pressure mercury vapor discharge lamps normally have an average mercury concentration of 0.005–0.1 mg/cm$^3$. These lamps have the disadvantage that they have a very low power density owing to their comparatively low power and comparatively large volume. This renders these lamps unsuitable for applications in which an intensive radiation is desired.

An embodiment of the lamp according to the invention is diagrammatically shown in the drawing, in which FIG. 1 shows a lamp in axial sectional view.

In FIG. 1, the discharge lamp 1 has a tubular lamp vessel 2 with an internal diameter D of between 10 and 15 mm, this internal diameter being 13.5 mm in the FIG. according to the invention, and a wall 4 which is permeable to UV radiation and which encloses a discharge space 5 in a gastight manner, said wall having a wall thickness 9 of approximately 1.75 mm. The lamp vessel 2 is manufactured from quartz glass which transmits UV radiation, but it may alternatively be a translucent ceramic lamp vessel which transmits UV radiation, for example made of densely sintered aluminum oxide (also known as "DGA material"). To achieve a desired spectrum of the effective LV output mainly at 255 nm within a wavelength region of 220 to 300 nm, the lamp 1 has a filling in the discharge space 5 exclusively comprising a starter gas, for example argon with a pressure of 1.33 kPa, and mercury with an average concentration of at least 0.4 mg/cm$^3$ and at most 2.5 mg/cm$^3$, in the Figure an average mercury concentration of approximately 0.7 mg/cm$^3$. Alternatively, however, the filling may comprise up to 0.2% by weight of usual impurities such as hydrocarbons, oxygen, nitrogen, and cadmium, but these are not essential for obtaining the desired spectrum of the effective UV output. A pair of electrodes 6 is arranged in the discharge space 5 and is provided with electrical contacting means to the exterior of the lamp vessel in the form of current leads 7 through the wall of the lamp vessel 2. The pair of electrodes has an electrode spacing L of approximately 240 mm, which substantially determines the total length of the lamp of approximately 300 mm. The lamp 1 of FIG. 1 has an operational power rating of 2500 W.

What is claimed is:

1. A mercury vapor discharge lamp (1) comprising:

a tubular lamp vessel (2) with a wall (4) which is permeable to UV radiation and which surrounds a discharge space (5) with a diameter D in a gastight manner;

a filling provided in the discharge space (5) and comprising mercury with an average concentration of at least 0.4 mg/cm$^3$ and of at most 2.5 mg/cm$^3$; and a pair of electrodes (6) with an electrode spacing L arranged in the discharge space (5), characterized in that the diameter D of the discharge space (5) is chosen so as to lie in a range from 10 to 15 mm.

2. A discharge lamp as claimed in claim 1, characterized in that the diameter D of the discharge space (5) is chosen so as to lie in the range from 12 to 14 mm.

3. (Amended) A discharge lamp as claimed in claim 1, characterized in that the electrode spacing L is chosen so as to lie in the range from 200 to 300 mm.

4. (Amended) A discharge lamp as claimed in claim 1, characterized in that the average mercury concentration in the discharge space (5) lies between 0.5 and 1.1 mg/cm$^3$.

* * * * *